US006854221B1

(12) United States Patent
Michaels

(10) Patent No.: US 6,854,221 B1
(45) Date of Patent: Feb. 15, 2005

(54) STRUCTURAL BUILDING BLOCK FOR USE IN WALL CONSTRUCTION, METHODS OF USING SAME, AND WALL CONSTRUCTED THEREWITH

(76) Inventor: Michael J. Michaels, 50500 Sass Rd., Chesterfield Township, MI (US) 48047

( * ) Notice: Subject to any disclaimer, the term of this patent is extended or adjusted under 35 U.S.C. 154(b) by 0 days.

(21) Appl. No.: 10/329,207

(22) Filed: Dec. 24, 2002

(51) Int. Cl.[7] ..... E02D 27/00
(52) U.S. Cl. ..... 52/102; 52/585.1
(58) Field of Search ..... 52/585.1, 102, 52/103, 70, 71, 600, 591.1; 446/108, 111, 112, 124, 102, 105; 256/24, 25, 26, 27, DIG. 6

(56) References Cited

U.S. PATENT DOCUMENTS

| | | | | | |
|---|---|---|---|---|---|
| 599,864 | A | * | 3/1898 | Rapp | 52/585.1 |
| 1,521,430 | A | * | 12/1924 | Campbell | 52/585.1 |
| 2,826,906 | A | * | 3/1958 | Rice | 52/585.1 |
| 3,921,348 | A | * | 11/1975 | Kurzen | 52/64 |
| 5,137,485 | A | * | 8/1992 | Penner | 446/111 |
| 5,168,678 | A | | 12/1992 | Scott, Jr. et al. | |
| D371,446 | S | | 7/1996 | VanDeusen | |
| D386,652 | S | | 11/1997 | Rimback et al. | |
| 6,062,772 | A | | 5/2000 | Perkins | |
| D438,992 | S | | 3/2001 | Chrisco et al. | |
| D448,859 | S | | 10/2001 | Doman | |
| 6,446,398 | B2 | * | 9/2002 | Weir | 52/71 |

FOREIGN PATENT DOCUMENTS

| | | | |
|---|---|---|---|
| EP | 0357282 | * | 8/1988 |

* cited by examiner

*Primary Examiner*—Peter M. Cuomo
*Assistant Examiner*—Stephen Vu
(74) *Attorney, Agent, or Firm*—Carrier, Blackman & Associates, P.C.; William D. Blackman; Joseph P. Carrier

(57) ABSTRACT

A building block includes a substantially rectangular block body, and may be used to make walls or edging for a landscaped area A first end of the block has spaced-apart fingers extending outwardly thereon. The outside corners of the finger tips are rounded off. The uppermost finger on the first end has an upper surface flush with the block top surface. Holes are formed coaxially through the fingers of the first end, with an axis substantially perpendicular to the block's longitudinal axis. Pins may be placed in the through holes to interconnect nested blocks. The second end is identical to the first end, rotated clockwise 180 degrees. Accordingly, the lowermost finger of the second end has a lower surface flush with the bottom surface of the block body. Multiple blocks may be combined with supplemental, reduced height blocks, and assembled in a staggered configuration to build a reinforced wall.

17 Claims, 12 Drawing Sheets

STRUCTURAL BUILDING BLOCK FOR USE IN WALL CONSTRUCTION, METHODS OF USING SAME, AND WALL CONSTRUCTED THEREWITH

BACKGROUND OF THE INVENTION

1. Field of the Invention

The present invention relates to structural building blocks, and to modular systems for constructing composite structures, such as walls and edging which are usable in landscaping. More particularly, the invention relates to an improved structural building block, and to composite structures constructed therewith.

2. Background Art

Several types of modular landscaping systems are known and in common use today for constructing retaining walls, edging and other landscaping structures. Common landscaping systems include wood timbers and concrete-like blocks.

Examples of some of the known landscaping timbers, structural building blocks, and related devices include U.S. design Pat. No. D371,446 to VanDeusen, U.S. design Pat. No. D386,652 to Rimback et al., U.S. design Pat. No. D438,992 to Chrisco et al., U.S. design Pat. No. D448,859 to Doman, U.S. Pat. No. 5,168,678 to Scott, Jr. et al., and U.S. Pat. No. 6,062,772 to Perkins.

Although the known landscaping timbers and structural building blocks are usable for their intended purposes, a need still exists in the art for an improved structural building block and modular system, which is usable to build landscaping retaining walls. In particular, there is a need for an improved structural building block which is combinable in a staggered configuration, to build an internally reinforced wall.

SUMMARY OF TIE INVENTION

The present invention provides a structural building block, which is usable to build a retaining wall, or to make edging for a landscaped outdoor area. A block according to the invention may be interconnectably combined with a plurality of similar blocks, and with fasteners, to build a wall structure. A building block according to a specific embodiment of the invention is constructed and arranged so that any one of a variety of different wall configurations may be made, according to the needs of a particular user. Blocks according to a particular embodiment of the invention may be combined in a staggered configuration, to build a relatively strong, internally reinforced wall. The blocks according to the invention may also be used to form edging at the perimeter of a landscaped outdoor area.

A building block according to a first embodiment of the invention includes a block body having front and rear faces, top and bottom surfaces, and first and second ends. The first end of the block has a plurality of spaced-apart fingers extending longitudinally outwardly thereon, substantially parallel to a longitudinal axis of the block. The second end of the block also has a plurality of spaced-apart fingers thereon. The fingers on the second end of the block are oriented and spaced to be alignable with empty spaces between other fingers on the first end of a second, substantially similar block, allowing adjacent similar blocks to nestingly interengage.

The fingers have side surfaces which are coextensive with, and substantially flush with the front and rear faces of the block. The tip ends of the fingers are radiused, so that the outside corner edges thereof are rounded off.

The uppermost finger on the first end has an upper surface which is substantially flush with the block top surface. Optionally, the upper surface of the uppermost finger may have a recess formed therein to accept a fastener head, allowing the fastener head to be situated at or below the level of the finger's upper surface.

As noted, the second end of the block also includes a plurality of spaced-apart fingers extending longitudinally outwardly thereon. The fingers of the second end are placed on the block body so as to line up vertically with spaces between the fingers of the first end.

The lowermost finger on the second end has a lower surface coextensive with, and substantially flush with the block bottom surface. Optionally, the lower surface of the lowermost finger may also have a recess formed therein to accept a fastener head.

The fingers of the respective first and second ends have through holes formed therethrough, with the through holes of each end coaxially aligned with one another. Each of the through holes has an axis which is substantially perpendicular to a longitudinal axis of the block.

It is an object of the present invention to provide a building block, and a modular system incorporating such building block, which can be used to construct a landscaping wall.

It is a further object to provide a building block and modular system which provides the ability to construct curved walls.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

First Embodiment

Figure 1A:
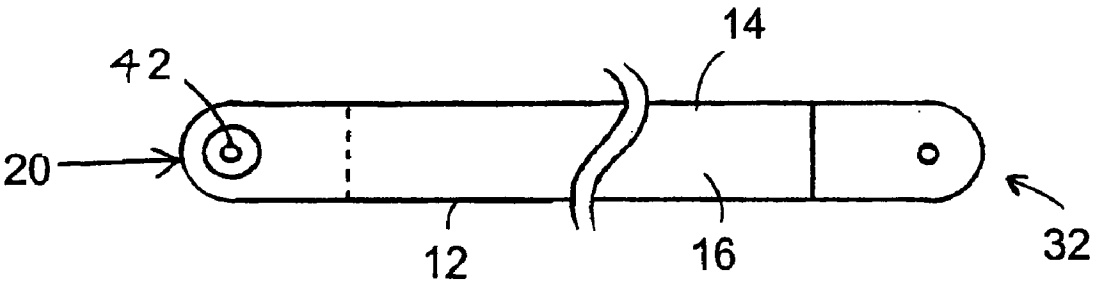
FIG. 1A is a top plan view of a first structural block in accordance with a first embodiment of the invention.

Referring to FIG. 1, there is shown a structural base block 10 according to a first embodiment of the invention. The block 10 includes a substantially rectangular central block body 11 having a front face 12, a back face 14, a top surface 16, a bottom surface 18, a first end 20, and a second end 32 opposite the first end. It will be understood that the block 10 may be made in any practical and appropriate length, such as, e.g., two feet, four feet, six feet, or other desired length.

The block 10 may be formed of wood, plastic, cement, or other known material. Where wood is used, treated wood, which is resistant to decay is preferred. Where plastic is used, the blocks may be hollow.

Figure 1B:
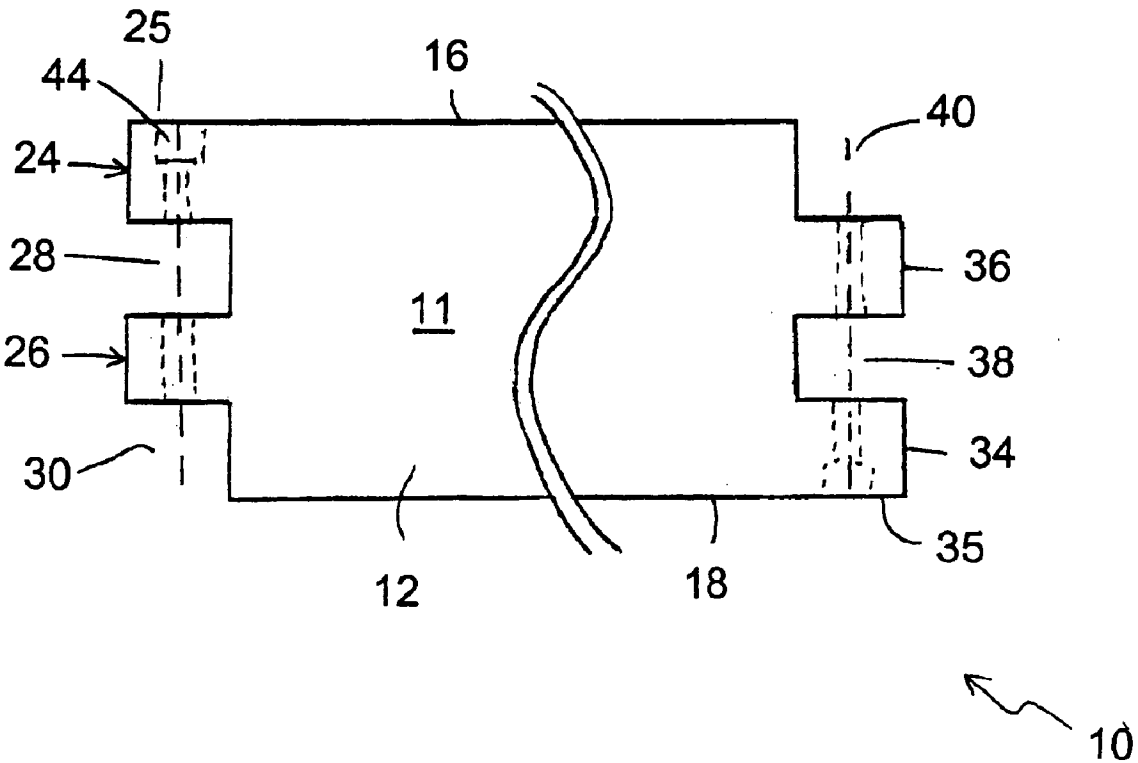
FIG. 1B is a side plan view of the block of FIG. 1.

Throughout the present specification, relative positional terms like 'upper', 'lower', 'top', 'bottom', 'horizontal', 'vertical', and the like are used to refer to the orientation of the block 10 as shown in the drawings, particularly FIG. 1B. These terms are used in an illustrative sense to describe the depicted embodiments, and are not meant to limit the scope or application of the invention. It will be understood that the depicted block 10 may be placed at an orientation different from that shown in the drawings, such as inverted 180 degrees or oriented transversely to the orientation shown, and in such a case, the above-identified relative positional terms will no longer be accurate.

In the base block 10 of FIG. 1, the first end 20 includes first and second fingers 24, 26 integrally formed with, and extending outwardly from the central block body 11. The first or uppermost finger 24 includes an upper surface 25, which is coextensive with, and flush with the top surface 16 of the block. The second finger 26 is located directly below the first finger 24 and is spaced away therefrom, thereby forming a gap 28 between the first and second fingers. The second finger 26 is substantially the same size as the first finger 24. Optionally, the height of each of the fingers 24, 26 may be approximately one fourth of the height of the block body 11, as shown in the drawing. A second gap 30 is provided directly below the lower second finger 26. The height of each of the gaps 28, 30 is just slightly larger than the height of one of the fingers 24 or 26.

As seen in the top view of FIG. 1A, the outer corners, at the tip ends of each of the first and second fingers 24, 26 are chamfered, or rounded off at the edges thereof. This may also be described as radiused, because the straight-line horizontal distance (radius) from the vertical center line of the hollow bore 42 in the fingers to any point on the outer surface of the finger tip should be approximately a constant value.

The second end 32 of the block 10 is substantially identical to the first end 20, if the block of FIG. 1B was rotated 180 degrees clockwise around the center point thereof. The second end 32 includes third and fourth fingers 34, 36, which are the same size as the first and second fingers 24, 26. The third, or lowermost finger 34 includes a lower surface 35 which is coextensive with, and flush with the block bottom surface 18. The fourth finger 36 is located directly above the third finger 34 and spaced upwardly away therefrom, thereby forming a gap 38 between the third finger 34 and the fourth finger 36. Another gap 40 is located directly above the fourth finger 36. These gaps 38, 40 are slightly larger than the vertical height of one of the fingers.

The tip portions of the fingers 34, 36 are radiused, as previously discussed, and also have coaxially located through-holes 42 formed therein.

It will be seen from FIG. 1B that the gap 28, between the first and second fingers 24, 26, is vertically aligned with the fourth finger 36 on the opposite side of the block 10, and the gap 30, below the second finger 26, is vertically aligned with the third finger 34. The respective fingers and gaps are dimensioned to allow the second end of a first block 10*a* (FIG. 2) to nestingly interengage with the first end of a second, identical block 10*b*, with the top and bottom surfaces of the respective blocks being substantially aligned.

Optionally, the lower surface 35 of the third finger 34 may have recesses 44 formed therein (FIG. 1B), to accept the head of a fastener 70, thereby making the fastener flush with the respective top or bottom surface of the block. In this way, blocks having fasteners installed therein may be vertically stacked on top of one another, if desired, without the fasteners creating unwanted space therebetween. Formation of a recess in the third finger 34 makes the first and second ends 20, 32, identical and interchangeable, so that the block is never upside down.

Figure 2:
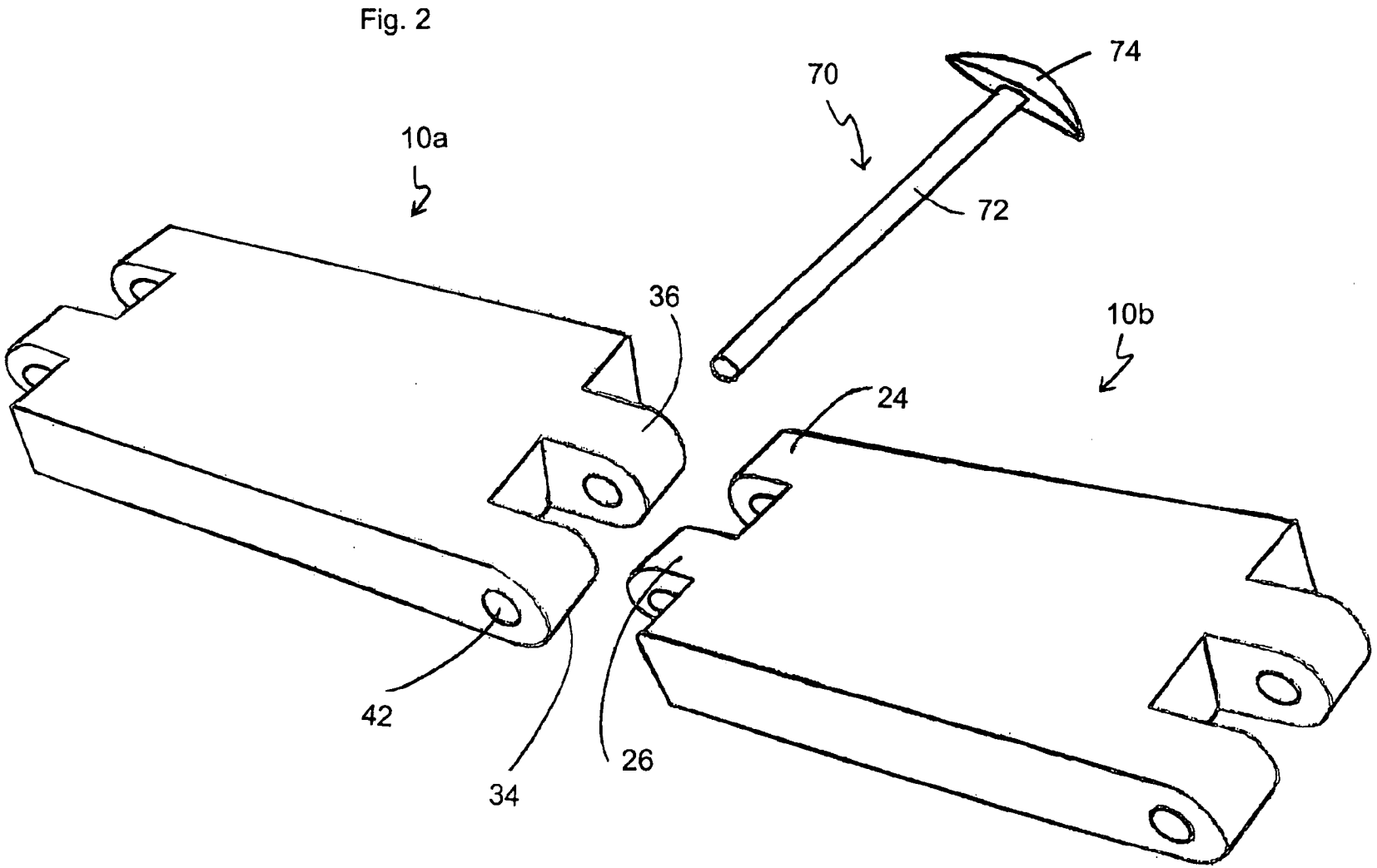
FIG. 2 is an exploded perspective view of two adjacent blocks and a connector according to the first embodiment.

FIG. 2 shows an exploded perspective view of two blocks 10*a*, 10*b* and a fastener 70 for interconnecting the blocks.

The first block 10*a* and second, substantially identical block 10*b* are joined together when the third and fourth fingers 34 and 36 of the first block nestingly engage into the gaps 28, 30 next to the fingers 24 and 26 of the second block. With the fingers nested together and the holes 42 aligned with one another, a fastener 70 is then pushed through the holes, thereby pivotally joining the blocks together.

The fastener 70 includes a substantially straight and cylindrical shaft 72, and an enlarged head 74 attached to an end of the shaft. The exact shape of the fastener head 74 is not critical. Where a recess 44 is used to receive the fastener head 74, the recess should be formed in a shape corresponding to the shape of the fastener head.

Since the ends of the fingers are radiused, as discussed above, the blocks 10*a*, 10*b* can be pivotally moved relative to one another around the fastener 70, to any desired angular relation up to 90 degrees, until the blocks contact and interfere with one another. In the larger view, this permits the formation of curved walls such as that shown in FIG. 4.

Optionally, the blocks 10 according to the invention may be formed from a single beam of wood or other starting material, and may be cut out using a laser beam, in an inert gas atmosphere. Nitrogen gas may be used. A five kilowatt laser may be required for this process. Such a method of making the blocks makes a very efficient use of the material, and produces blocks having darkened, carburized surfaces where the cuts have been made.

Wall Construction

Aligning a multiplicity of blocks 10 in a manner as described, and connecting the blocks with fasteners 10, a user can build a landscaping retaining wall in any desired shape that the pivotally movable blocks 10 can be placed into.

Figure 3:
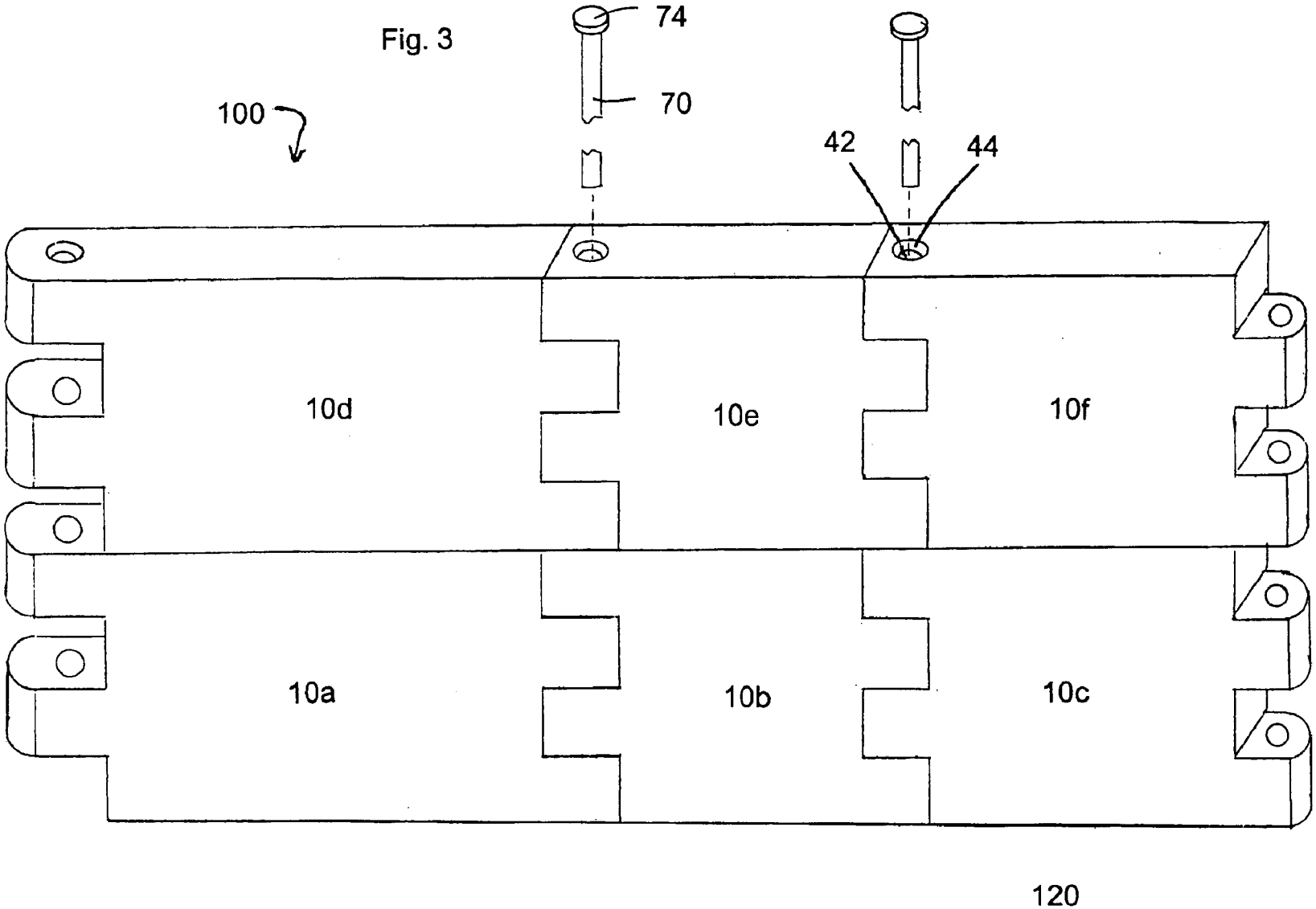
FIG. 3 is a perspective view of a first wall section built using a plurality of blocks according to the first embodiment hereof.

A first example of a wall 100 built with a multiplicity of blocks 10, according to the first embodiment of the invention, is shown in FIG. 3. In the wall of FIG. 3, all of the blocks 10 in a given row are lined up end-to-end with coplanar top surfaces and coplanar bottom surfaces.

A plurality of structural blocks 10*a*–10*f* can be joined together to form a wall 100 as illustrated in FIG. 3. Each row of blocks is assembled in a manner such that the fingers of each block nest with the corresponding fingers of an adjacent block, with the upper surfaces 16 of the adjacent blocks in horizontal alignment with one another, thereby creating distinct, vertically stacked rows of blocks.

While two rows of blocks are shown in FIG. 3, it will be understood that three, four or more rows may be used, as appropriate for a particular installation.

The blocks 10 are fastened together and to the substrate 120 with fasteners 70, such that the fasteners pass through the through holes 42 and into the substrate, thereby joining the blocks together and securing the wall structure to the substrate, which may be ground. The head 74 of each fastener 70 fits into the recess 44 at the top of the finger through-holes 42, thereby making the fastener head flush with the surface of the respective block.

If desired, some of the fasteners can be made extra long, or else can be installed so that they extend down into the cement or other substrate that the wall 100 is being built on.

Alternatively, in the wall design of FIG. 3, where appropriate, a single, long fastener 70 may be used, for each connection point between adjacent blocks, to extend downwardly through all of the rows of blocks. The use of a single, long fastener 70 at each connection point also serves to join the vertical rows together. This long fastener may further extend through the blocks and into the substrate 120 to anchor the wall in place.

Figure 4:
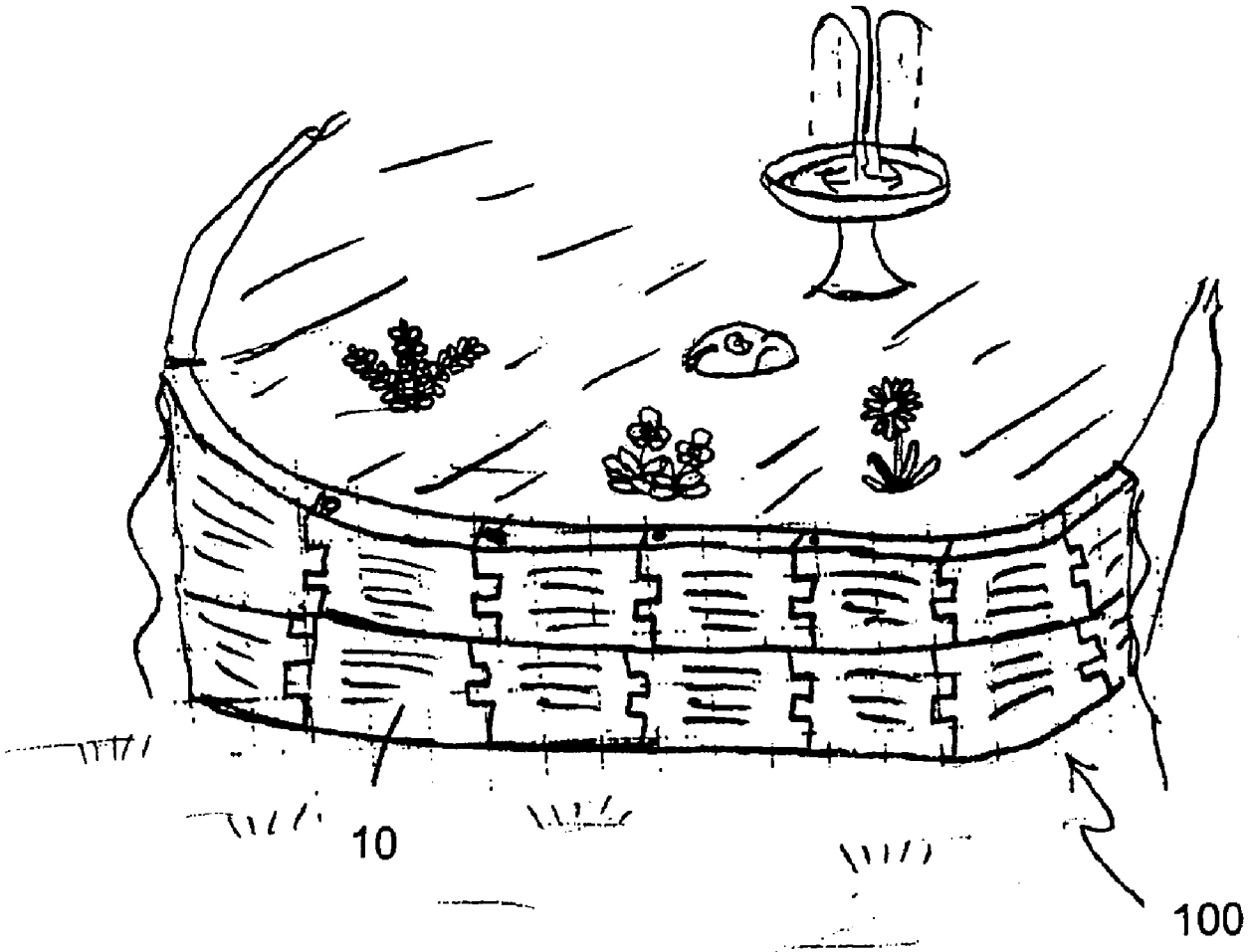
FIG. 4 is an expanded view of the wall section of FIG. 3, showing how the blocks can be used to form a curved wall.

A larger three-dimensional view of the wall 100, showing curvature on part of the wall caused by pivotally moving selected blocks relative to one another, is shown in FIG. 4. Once such a wall is built, and placed into the preferred orientation thereof, dirt may be filled in behind the wall to provide a terraced effect.

As previously noted, blocks 10 of different lengths can be made, and optionally, in the practice of the present invention, different length blocks could be combined with one another. This allows for an overall shape of a landscaped area that is flat, rounded or and/or curved in different sections thereof, according to the requirements of a particular user. The shape of the landscaped area can be customized to fit the available space for a particular application.

Supplemental Short Block

Figure 5A:
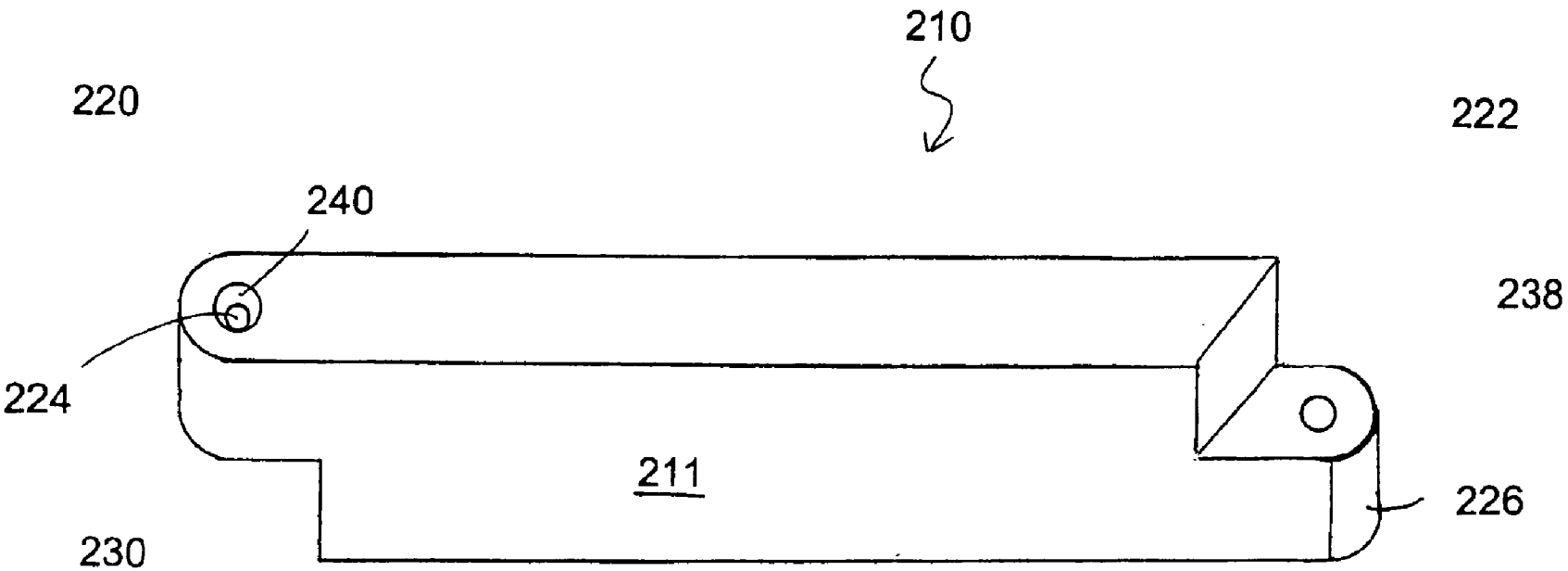
FIG. 5A is a perspective view of a supplemental block which can be used in conjunction with the block of FIGS. 1A–1B as part of a system.
Figure 5B:
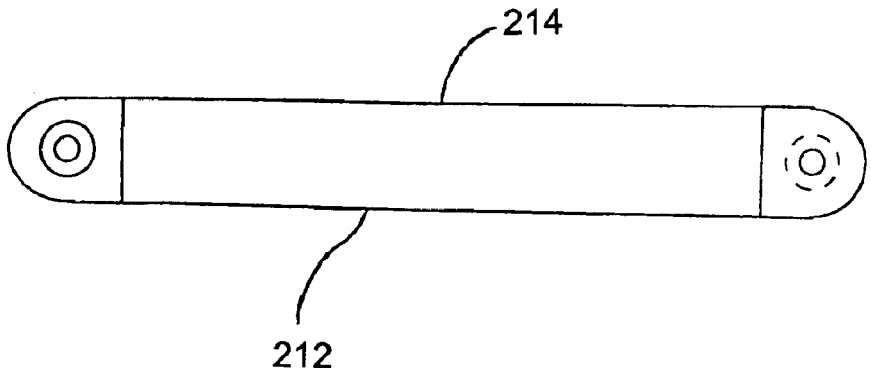
FIG. 5B is a top plan view of the block of FIG. 5A.
Figure 5C:
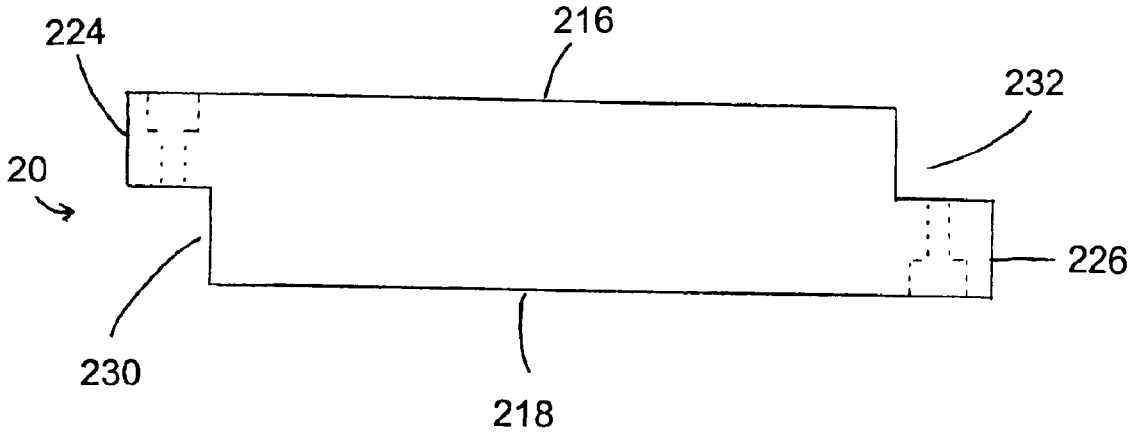
FIG. 5C is a front plan view of the block of FIGS. 5A–5B.

FIG. 5 illustrates a supplemental short block 210 according to a second embodiment of the invention. The short block 210 is provided for use in combination with the base block 10, to build a reinforced wall 200 (FIG. 6), in which the base blocks 10 are arranged in a vertically staggered configuration.

The short block 210 resembles one of the base blocks 10 which has been cut in half along a horizontal center plane thereof and had one of the resulting pieces removed.

The short block 210 includes a rectangular block body 211 having front and back faces 212, 214, top and bottom surfaces 216, 218 and first and second ends 220, 222. The first end 220 of the block 210 has a single, upper finger 224 extending outwardly thereon above a gap 230. The second end 222 of the block 210 has a single, lower finger 226 extending outwardly thereon below a gap 232. Each finger has a through-hole 238 formed therein and an enlarged recess 240 for accepting a fastener head.

Alternate Wall Construction

Figure 6:
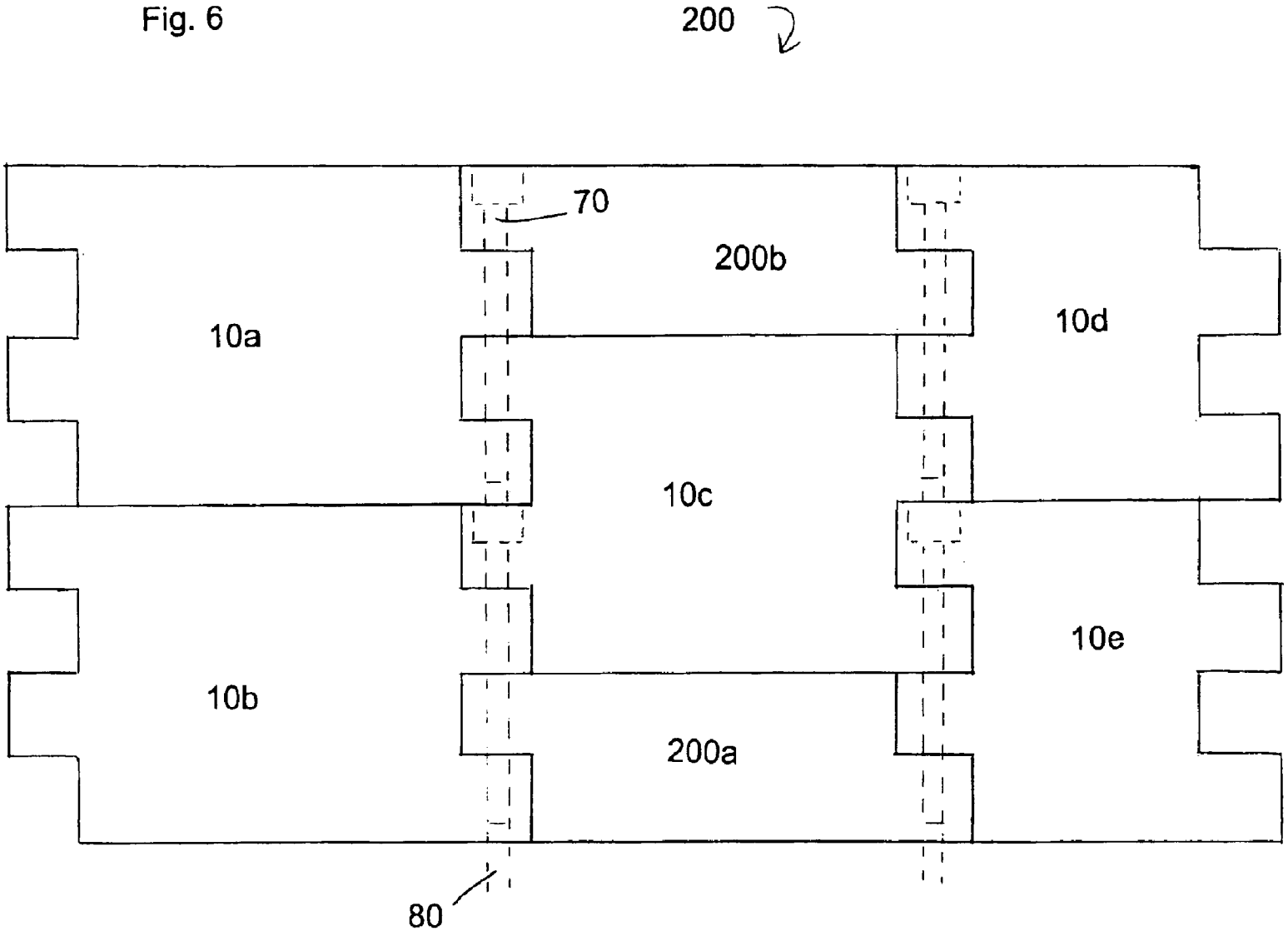
FIG. 6 is a perspective view of a second wall section built using a plurality of blocks according to a second embodiment hereof, using the base blocks of FIGS. 1–2 in combination with a plurality of the supplemental blocks of FIG. 5.
Figure 7:
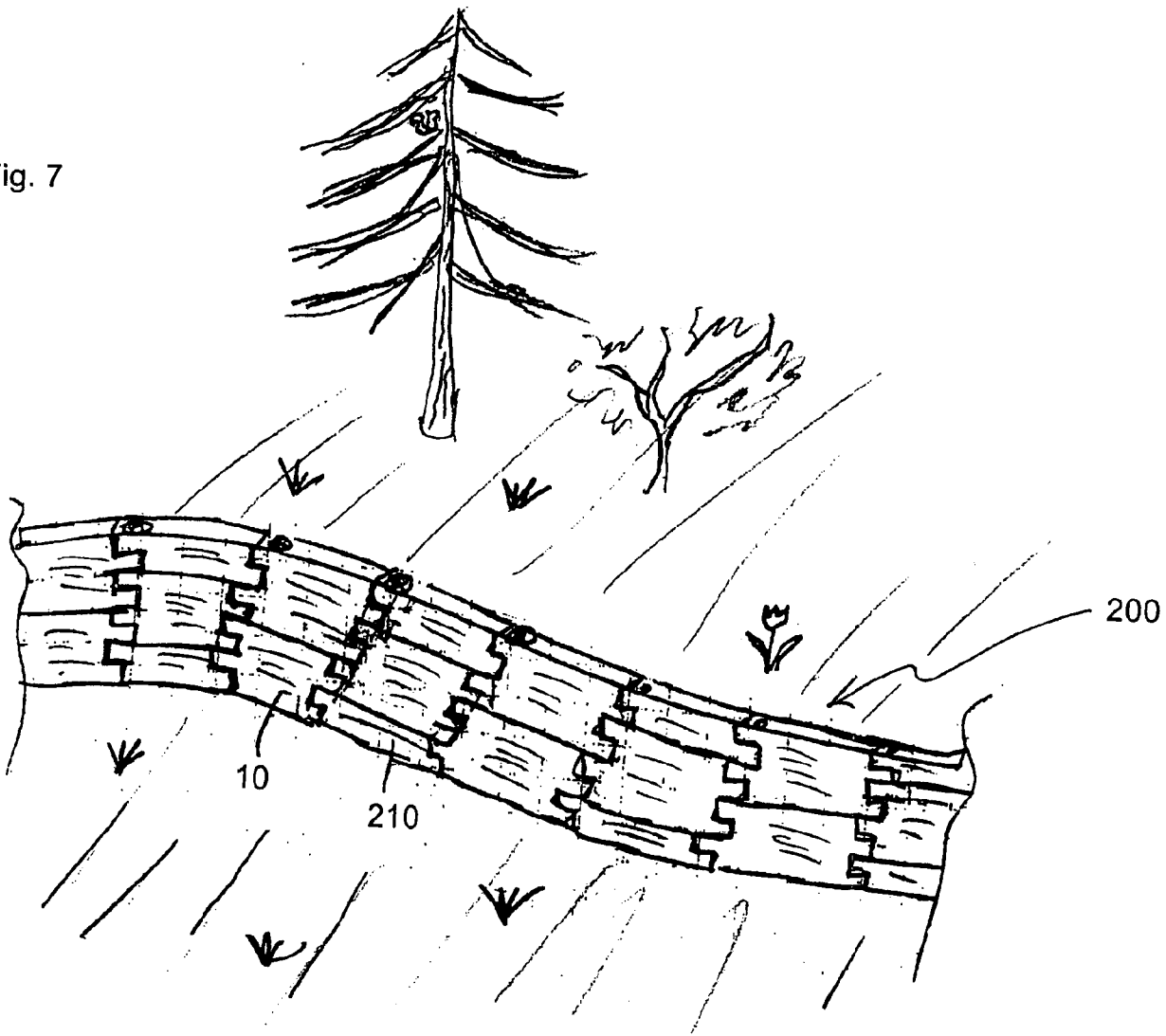
FIG. 7 is an expanded view of the wall section of FIG. 6, showing how the blocks can be used to form a curved wall.

FIGS. 6–7 illustrate a wall which can be constructed using both the base blocks 10 and the short blocks 210. If the base blocks 10 are alternated with the short blocks 210 in a first row of a wall, a base row having a staggered upper profile is achieved. Wherever short blocks 210 (such as that shown at 200*a*) are found in the lower row, a base block 10 is set on top of each short block 210, with yet another short block 210 (such as that shown at 200*b*) stacked thereon, as shown (for a wall of the height illustrated).

In this way, a reinforced wall construction 200 is realized in which the base blocks 10 are vertically staggered relative to one another. Fasteners 70 are used in a manner similar to that used in constructing the wall 100 of FIG. 3.

This creates an internally reinforced wall having greater strength and structural integrity than the wall 100 of FIGS. 3–4. In the wall 200 according to the second embodiment, the subsequent rows are interdependent and interconnected to one another.

It will be understood that this pattern may be modified to make a wall of any desired height, and that for a different wall height, more of the base blocks 10 could be used between the top and bottom rows. For a higher wall, the second row would all be base blocks 10, which could be repeated for additional rows as desired.

FIG. 7 illustrates that the wall 200 may also be made with some curvature therein, as desired, and may be used as a retaining wall for landscaping purposes.

Optional Finishing Block

Figure 8:
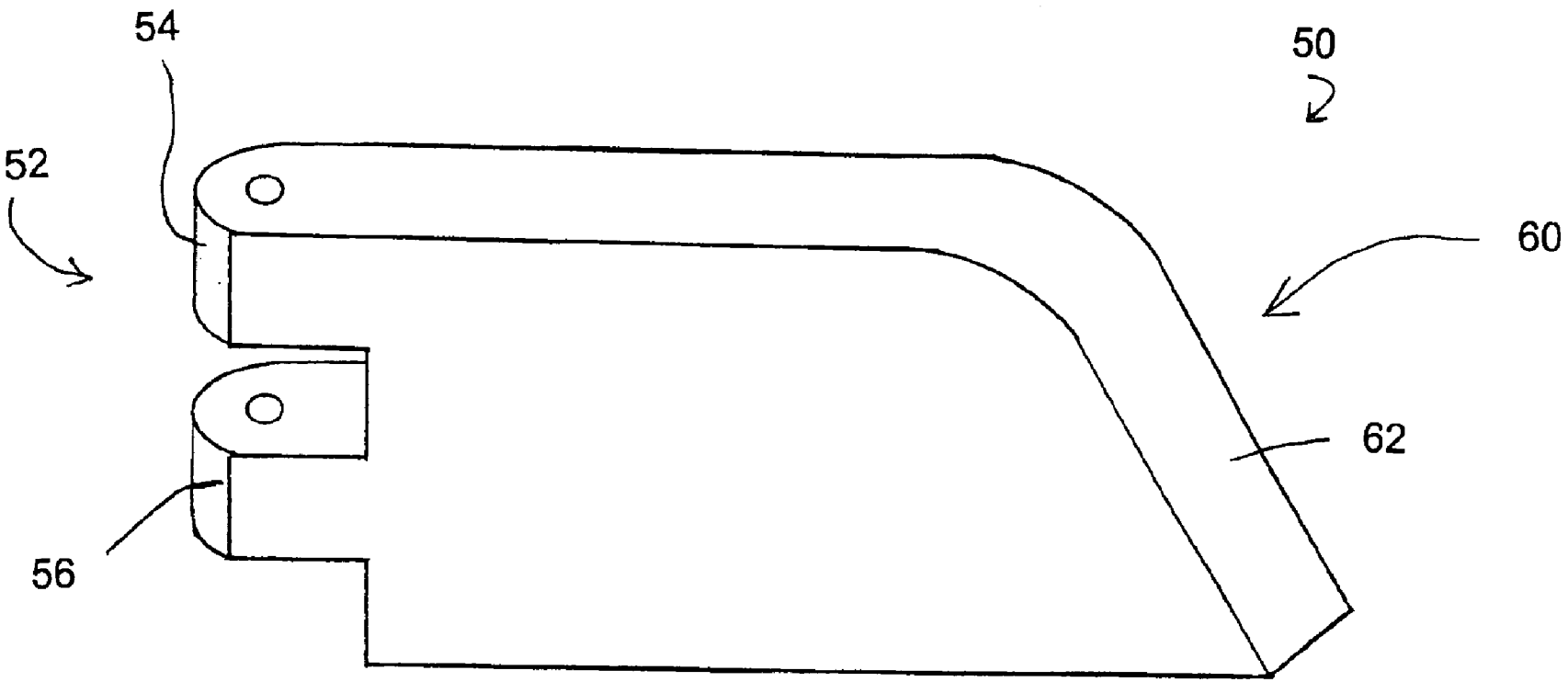
FIG. 8 is a perspective view of a finishing block which is usable with a system according to the present invention.
Figure 9:
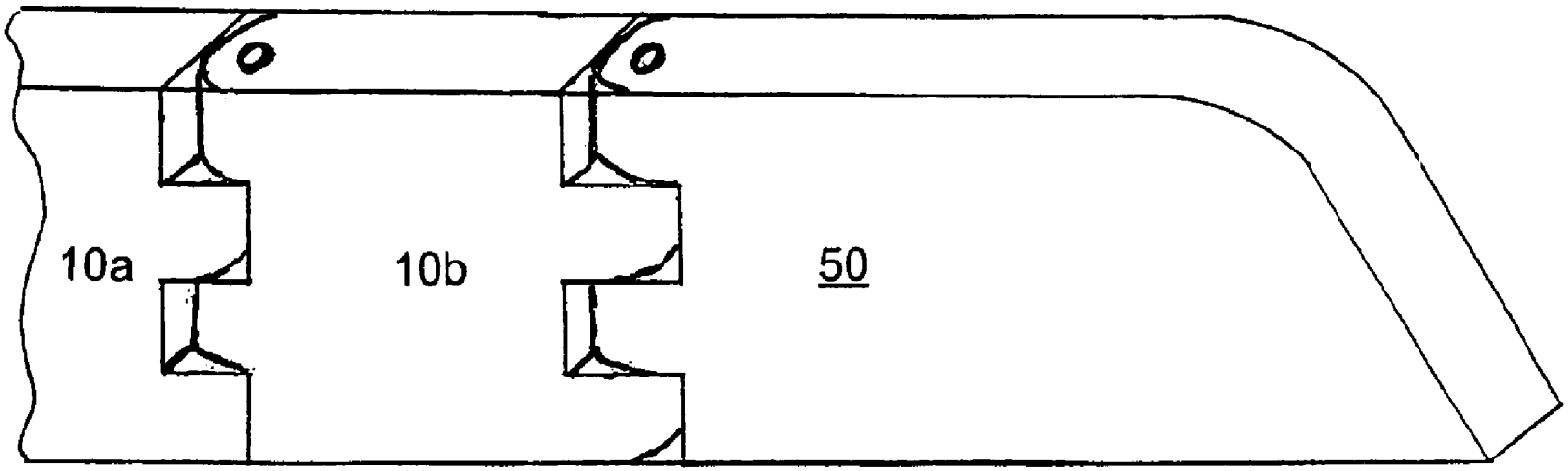
FIG. 9 is a perspective view of a series of interconnected blocks including the finishing block of FIG. 8.

Referring now to FIGS. 8–9, an optional finishing block in accordance with the invention is shown generally at 50. The finishing block 50 is provided for optional use in making an end wall face with a substantially smooth side edge. The block 50 has a first end 52, which is substantially similar to the first end 20 of the base block 10, as previously described. The first end 52 of the finishing block 50 has two spaced-apart fingers 54, 56 extending outwardly thereon, which are the same size, shape and orientation as the first and second fingers 24, 26 on the base block 10.

The finishing block 50 also has a second end 60 with an outer edge 62 having a substantially smooth and unbroken surface. The outer edge 62 of the finishing block 50 can be oriented substantially vertically, or may alternatively be disposed at an angle with respect to the vertical, as shown.

FIG. 9 illustrates how the finishing block 50 may be combined with two of the base blocks 10*a*, 10*b* to form a series having a substantially smooth and unbroken outer edge.

Insert Member—Third Embodiment

Figure 10:
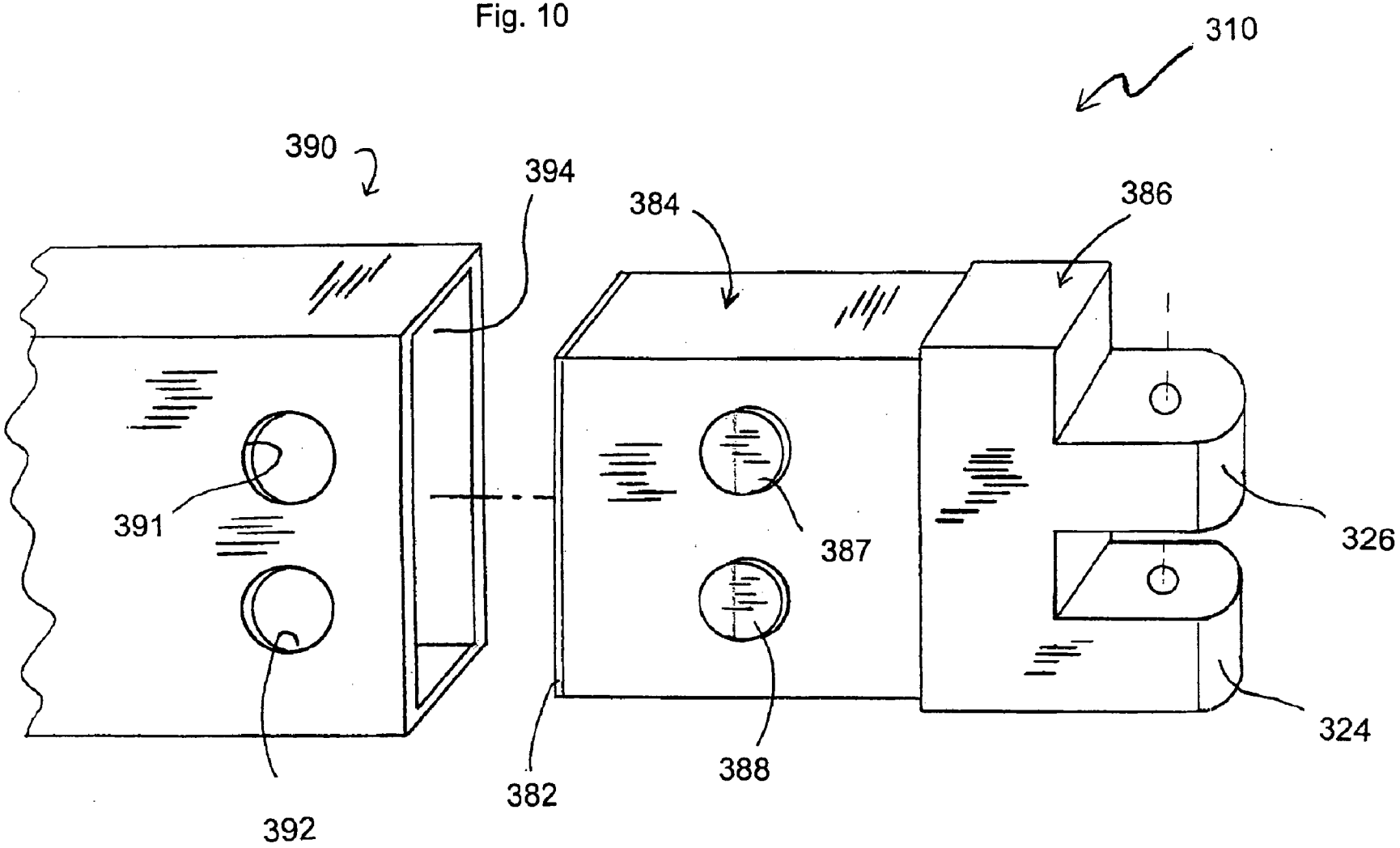
FIG. 10 is an exploded perspective view of a connecting block insert and a hollow landscape timber according to a third embodiment of the invention.
Figure 11:
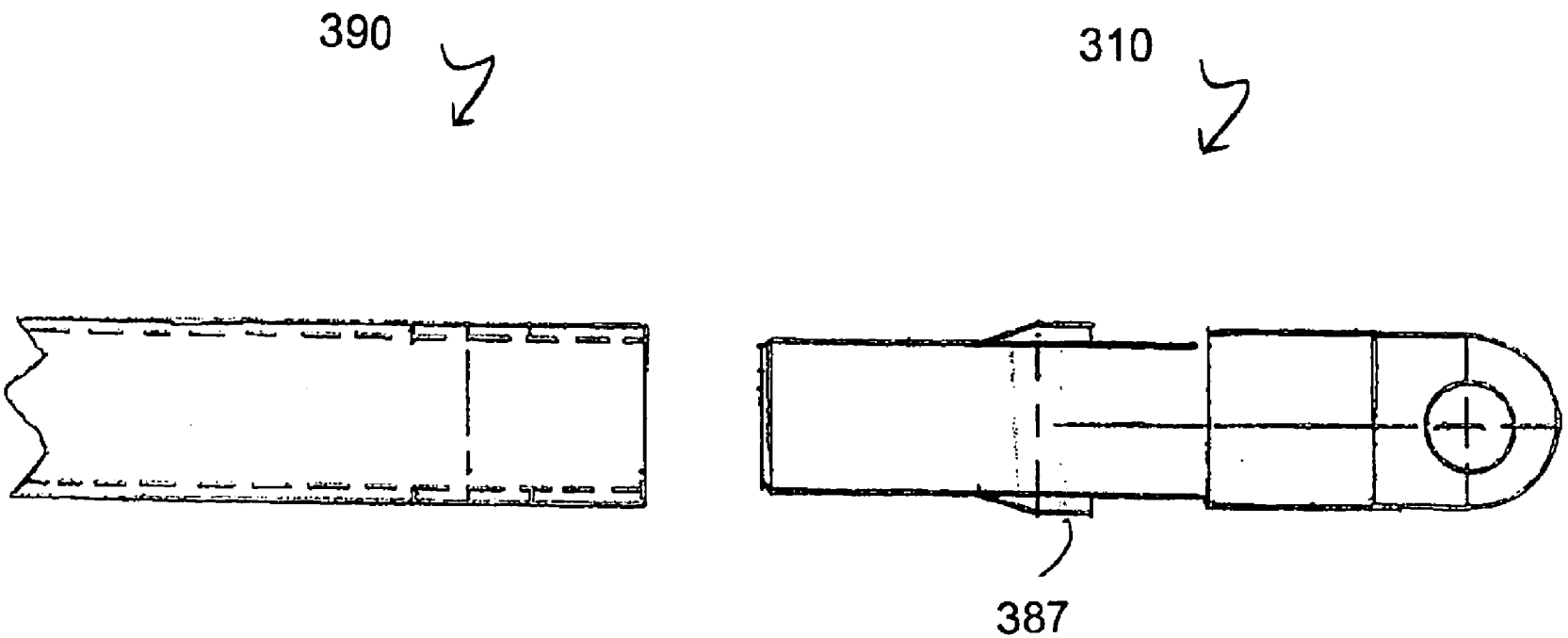
FIG. 11 is a top plan view of the insert and landscaping timber of FIG. 10.

An optional insert member 310 is shown in FIGS. 10–11, according to a third embodiment of the invention. The insert member 310 is intended for use in conjunction with a hollow, plastic landscaping timber 390.

The insert member 310 includes a reduced diameter section 384 for slidable placement inside of the open end 394 of the landscaping timber 390, and a larger working section 386 having a plurality of fingers 324 and 326 thereon, which will nestingly interconnect with corresponding fingers on similar end block insert members. The landscaping timber has a plurality of holes 391, 392 formed therein, and the reduced diameter section 384 of the insert member has corresponding three-dimensional extensions 387, 388 protruding outwardly thereon for locking engagement in the holes 391, 392.

The structure of the working section 386 is similar to the corresponding portion of the base block 10, as previously described. It will be understood that an insert in the orientation shown in FIG. 8 may be nestingly interengaged with a similar insert which has been inverted top-to-bottom and rotated 180 degrees from the orientation of the insert in the drawing.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

Having, thus, described the invention, what is claimed is:

1. A structural block for use in combination with other, similar blocks, said block comprising a unitary block body having a front face, a rear face, a top surface, a bottom surface, a first end and a second end integrally connected to said first end;

said first end of said block body having a plurality of spaced-apart fingers extending longitudinally outwardly thereon, wherein an uppermost of said fingers of said first end has an upper surface substantially flush with said top surface of said block; and said second end of said block body having a plurality of spaced-apart fingers extending longitudinally outwardly thereon, a lowermost of said fingers of said second end having an lower surface which is substantially flush with said block bottom surface, wherein said fingers of said second end are vertically displaced from said fingers of said first end.

2. The structural block of claim 1, wherein the first end has two of said fingers, and wherein the second has two of said fingers.

3. The structural block of claim 2, wherein each of said fingers has a height approximately one fourth of the height of said block body.

4. The structural block of claim 1, wherein each of said fingers has a tip and which is rounded at the outside corners thereof, and further wherein said fingers are provided in a width which is substantially equal to the width of a portion of said block body adjacent to and spaced inwardly from said fingers.

5. The structural block of claim 1, wherein each of said fingers has a hole formed substantially vertically therethrough, wherein each of said through holes has a diameter less than half of the width of said block between said front and rear faces thereof, and an axis which is substantially perpendicular to a longitudinal axis of said block;

and further wherein said fingers are provided in a width which is substantially equal to the width of a portion of said block body adjacent to and spaced inwardly from said fingers.

6. The structural block of claim 1, wherein each of said fingers has opposed side surfaces which are coextensive and substantially flush with said front and rear faces of said block body, respectively.

7. The structural block of claim 1, wherein said block comprises wood which has been cut using a laser cutting process.

8. The structural block of claim 1, wherein the top and bottom surfaces of the block are substantially solid and continuous in the areas thereof between the front and rear faces of the block.

9. A structural base block for use in combination with other, similar blocks, said base block comprising a unitary main block body having a top surface, a bottom surface, a first end and a second end integrally attached to said first end, said block further having a longitudinal axis;

said first end of said block body having a first finger extending outwardly thereon substantially parallel to said longitudinal axis, said first finger having a measurable height and having an upper surface which is substantially coextensive with said block top surface, said first end further having a second finger disposed below said first finger and spaced downwardly away from said first finger by an amount substantially equal to said measurable height, thereby forming a gap between said first and second fingers;

said second end of said block body having a third finger extending outwardly thereon substantially parallel to said longitudinal axis, said third finger having a height substantially equal to the height of said first finger, said third finger having a lower edge substantially coextensive with said block bottom surface, said second end further having a fourth finger disposed above said third finger and spaced upwardly away from said third finger by an amount substantially equal to said measurable height, thereby forming a gap between said third and fourth fingers, whereby a first end of a second, substantially identical block can be nestingly interengaged with the second end of said base block.

10. The block of claim 7, wherein said fingers have tips which are chamfered to permit pivotal movement of the block relative to said second, substantially identical block when said ends are nestingly interengaged.

11. A modular building system, comprising a plurality of base blocks having a unitary main block body having a top surface, a bottom surface, a first end and a second end integrally attached to said first end, said block further having a longitudinal axis;

said first end of said block body having a first finger extending outwardly thereon substantially parallel to said longitudinal axis, said first finger having a measurable height and having an upper surface which is substantially coextensive with said block top surface, said first end further having a second finger disposed below said first finger and spaced downwardly away from said first finger by an amount substantially equal to said measurable height, thereby forming a gap between said first and second fingers;

said second end of said block body having a third finger extending outwardly thereon substantially parallel to said longitudinal axis, said third finger having a height substantially equal to the height of said first finger, said third finger having a lower edge substantially coextensive with said block bottom surface, said second end further having a fourth finger disposed above said third finger and spaced upwardly away from said third finger by an amount substantially equal to said measurable height, thereby forming a gap between said third and fourth fingers whereby a first end of a second, substantially identical block can be nestingly interengaged with the second end of said base block, and a plurality of fasteners for interconnecting adjacent blocks.

12. The modular building system of claim 11, further comprising a plurality of supplemental blocks which are approximately half as high as said base block, to allow staggered assembly of said base blocks.

13. A composite structure comprising a plurality of structural base blocks, each of said base blocks having a defined height and having a first end with at least two spaced apart fingers extending outwardly thereon, and a second end with at least two spaced apart fingers extending outwardly thereon, said fingers of said first and second ends respectively having holes formed substantially vertically therethrough, wherein said fingers are provided in a width which is substantially equal to the width of a portion of said block adjacent to and spaced inwardly from said fingers:

said structure being constructed and arranged such that the fingers of said second end of a first base block are in contact with a first end of a second, substantially identical base block, and selected through holes of said base blocks are aligned with one another;

said structure further comprising a plurality of fasteners for pivotally fastening said structural blocks together, wherein each of said fasteners comprises a substantially straight shaft for placement in said aligned through holes to interconnect said blocks, and a fastener head attached to said shaft; wherein said fastener shaft has a diameter which is less than half the width of one of said fingers.

14. The structure of claim 13, wherein each of said fingers bas a tip end which is rounded at the outside corners thereof whereby selected blocks can be oriented at an angle with respect to one another.

15. The structure of claim 13, further comprising a plurality of supplemental blocks which have a height about half of the height of said base blocks, said supplemental blocks being used alternately with said base blocks in the bottom row of said structure, so that said base blocks may be arranged in a staggered configuration.

16. The structure of claim 13, wherein said structure comprises a wall.

17. The structure of claim 13, wherein said structure comprises edging for a landscaped area.

* * * * *